US008728249B2

(12) United States Patent
Slomp et al.

(10) Patent No.: US 8,728,249 B2
(45) Date of Patent: May 20, 2014

(54) PACKING MACHINE

(75) Inventors: Tieme Jan Slomp, Bad Groenenbach (DE); Ivo Ruzic, Kempten (DE); Elmar Ehrmann, Bad Groenenbach (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 718 days.

(21) Appl. No.: 12/227,015

(22) PCT Filed: May 4, 2007

(86) PCT No.: PCT/DE2007/000809

§ 371 (c)(1),
(2), (4) Date: Jul. 7, 2009

(87) PCT Pub. No.: WO2007/128282

PCT Pub. Date: Nov. 15, 2007

(65) Prior Publication Data

US 2010/0218792 A1 Sep. 2, 2010

(30) Foreign Application Priority Data

May 5, 2006 (DE) ..... 10 2006 021 345

(51) Int. Cl.
*B08B 9/00* (2006.01)

(52) U.S. Cl.
USPC ..... 134/166 R; 134/169 R

(58) Field of Classification Search
USPC ..... 134/166 R, 169 R; 198/495, 500
See application file for complete search history.

(56) References Cited

U.S. PATENT DOCUMENTS

| | | | | |
|---|---|---|---|---|
| 2,271,436 | A * | 1/1942 | Lathrop | 198/495 |
| 2,718,895 | A * | 9/1955 | Thomas et al. | 134/83 |
| 3,231,931 | A * | 2/1966 | Dethloff et al. | 452/128 |
| 3,648,624 | A * | 3/1972 | Verhoeven | 425/232 |
| 4,226,325 | A * | 10/1980 | Vandas | 198/493 |
| 4,336,680 | A * | 6/1982 | Grevich | 53/389.2 |
| 4,830,175 | A * | 5/1989 | Durst et al. | 198/495 |
| 4,993,538 | A * | 2/1991 | Norbury | 198/495 |
| 5,117,967 | A * | 6/1992 | Morrow et al. | 198/495 |
| 5,119,929 | A * | 6/1992 | Carlson | 198/377.06 |
| 5,127,416 | A * | 7/1992 | Wakabayashi et al. | 134/104.1 |
| 5,865,293 | A * | 2/1999 | Napadow | 198/495 |
| 5,913,984 | A * | 6/1999 | Lofdal | 134/18 |
| 6,367,613 | B1 * | 4/2002 | Montgomery | 198/495 |
| 6,651,803 | B2 * | 11/2003 | Virippil et al. | 198/495 |
| 7,114,209 | B2 * | 10/2006 | Metzger-Groom et al. | 8/158 |

FOREIGN PATENT DOCUMENTS

| | | | |
|---|---|---|---|
| DE | 37 12 474 | * | 11/1988 |
| DE | 689 05 158 | T2 | 6/1990 |
| DE | 19508357 | A1 | 9/1996 |

(Continued)

OTHER PUBLICATIONS

WIPO WO 02/08095 Jan. 2002.*

(Continued)

*Primary Examiner* — Jason Ko
(74) *Attorney, Agent, or Firm* — Brooks Kushman P.C.

(57) ABSTRACT

Proposed is a packing machine (1), in particular a roller or deep drawing machine, tray sealing machine or the like with components which have to be cleaned regularly, in which machine the cleaning of the components to be cleaned is improved. This object is achieved in that the packing machine (1) comprises a fluid supply unit (16) for providing at least one cleaning fluid.

21 Claims, 4 Drawing Sheets

(56) References Cited

FOREIGN PATENT DOCUMENTS

| | | | | |
|---|---|---|---|---|
| DE | 197 19 198 | A1 | | 11/1998 |
| DE | 197 53 327 | A1 | | 6/1999 |
| DE | 102 44 809 | B4 | | 4/2004 |
| DE | 103 51 213 | A1 | | 6/2005 |
| EP | 0 374 586 | | | 6/1990 |
| EP | 0 903 320 | A1 | | 3/1999 |
| EP | 1 403 187 | A1 | | 3/2004 |
| FR | 2 852 849 | | * | 10/2004 |
| JP | 07-174714 | | * | 7/1995 |
| JP | 2000-185047 | | * | 7/2000 |
| WO | 9628263 | A1 | | 9/1996 |

OTHER PUBLICATIONS

Letter of Opposition Dated Feb. 14, 2013, filed by Patentanw•Ite Vollmann & Hemmer against European Patent No. 2 024 236 to MULTIVAC Sepp Haggenmueller GmbH & Co. KG, including Attachments E2-E11, 117 Pages.

* cited by examiner

PACKING MACHINE

CROSS-REFERENCE TO RELATED APPLICATIONS

This application is a U.S. national phase of PCT Application No. PCT/DE2007/000809 filed May 4, 2007, which claims priority to German Application No. 10 2006 021 345.9 filed May 5, 2006, the disclosures of which are incorporated in their entirety by reference herein.

TECHNICAL FIELD

The invention relates to a packaging machine, in particular a roller or deep drawing machine, a tray sealing machine or the like.

BACKGROUND

Packing machines of this type are frequently used in the packing of food products and must therefore meet correspondingly high hygiene standards. In particular, machines of this type are regularly cleaned and disinfected in order to reliably prevent contamination of the product to be packed caused by residues or germs from the packing machine.

The cleaning of the machines represents a not insignificant cost entailing corresponding machine downtimes.

SUMMARY

The object of the invention is accordingly to propose a packing machine in which the cleaning of the components to be cleaned is improved.

This object is achieved in that a fluid supply unit is provided for cleaning the region of the packing machine that is configured below a plane of conveyance for tray-like packing containers and between side walls of the packing machine.

The term "plane of conveyance" refers in the sense of the invention to the upper rim of the tray-like packing container which is guided through the packing machine for packing the product thereby to be packed. The tray-like packing containers can in this case, depending on the embodiment, be supplied as preproduced trays, known as tray sealers, and be guided through the packing machine or be formed by a shaping station, for example by means of a film deep drawing process, in the packing machine, in a film which is also guided through the packing machine. In the second case, the plane of conveyance is thus at the same time the plane in which the film provided with the packing troughs is conveyed through the packing machine.

According to the invention, the term "side walls" refers to lateral delimitations of the packing machine, such as for example corresponding portions of a housing of the packing machine that separate off, preferably in an at least predominantly fluid-tight manner, the interior thereby described of the packing machine from the external environment. It is thus possible to clean this interior of the packing machine even when the cleaning fluid cleaning the interior is subjected to pressure, without adversely affecting the environment. In particular for the cleaning of regions which are particularly susceptible to impurities such as for example rims, edges, undercuts, cavities, channels, movable and/or clamping elements and the like, even hard spray jet can be used in an interior closed off in this manner to remove impurities which may cling tight or be clamped in, such as is the case for example as a result of the drying-up of components which are in particular intensively heated and/or subjected to a suction effect and/or clamping effect at least intermittently and to which residues of the product to be packed and/or of the packing material can adhere.

In addition to this basically advantageous possibility for cleaning interiors of all types of packing machines, a fluid supply unit can achieve the object in accordance with a second embodiment of the invention, in that the packing machine comprises a fluid supply unit for providing a cleaning fluid.

The measures referred to in the sub-claims allow the invention to be carried out and developed in an advantageous manner.

A packing machine configured in accordance with the invention is capable of automatically cleaning itself or components at least partly to be cleaned, during operation or in pauses in operation, for example in corresponding cleaning intervals.

In a particularly advantageous embodiment of the invention, the fluid supply unit comprises a water connection to a water supply network. In this way, the fluid supply unit can produce a water-based cleaning fluid as required without stocking being required to supply water. It is also possible to rinse off a cleaning agent and/or disinfectant in this way.

Preferably, the fluid supply unit is provided with a connection for taking up at least one liquid cleaner. Liquid cleaners of this type, which are for example acidic and/or alkaline, can in this case be obtained for example from a storage container or else from an operationally internal supply network. In this case, the liquid cleaner can be obtained already in a ready-to-use form and/or as a concentrate to be diluted.

In a particularly advantageous embodiment of the invention, the fluid supply unit comprises a metering and/or mixing unit in order to meter and/or to mix at least one cleaning fluid from at least one cleaner and the water available via the water connection.

In a development of the invention, the fluid supply unit is in addition provided with a connection for at least one disinfectant which can, again, be obtained from a storage container or from an operationally internal supply network.

In this way, the fluid supply unit is capable of providing not only one or more cleaning fluids of the desired quality, but rather also one or more disinfectants during or after the cleaning. The disinfection can in this case be carried out at the same time as the fluid cleaning, for example by the metered addition of disinfectant to a cleaning fluid through a corresponding metering unit of the fluid supply unit. However, it is preferable for an independent operation, which serves exclusively to disinfect, to be carried out after the cleaning. The disinfectant or disinfectants can in this case be obtained in a ready-to-use state via one or more connections of the fluid supply unit or else be provided by means of a metering and/or mixing unit, by way of the fluid supply unit, for example by metering and/or adding water which is supplied to the fluid supply unit via the above-mentioned water connection.

Advantageously, the fluid supply unit is provided with a store for at least one cleaner. A cleaner of this type can for example be present in liquid or in solid form. The cleaner can in this case be provided as a concentrate and/or in a ready-to-use state. The store of the fluid supply unit can in this case be configured as a refill store or as an exchangeable store. An exchangeable store offers in this case advantages, in particular in the handling of a cleaner displaying a certain chemical aggressivity, as merely a corresponding cleaner container has to be exchanged, without contact with the cleaner. A solid cleaner can moreover be used in differing forms, for example in a pressed form or in metered units, such as cleaner tablets, or else in powdered form.

In a development of the invention, the fluid supply unit is furthermore provided with a store for at least one disinfectant. A disinfectant of this type can, again, be provided in liquid and/or solid form. The store for the disinfectant or disinfectants can, as in the case of the cleaner, be configured either as a refill store and/or as an exchangeable store. A disinfectant can in this case be provided in the store as a concentrate or as a ready-to-use disinfectant.

In an advantageous development of the invention, the fluid supply unit is furthermore provided with a compressed gas connection, for example a compressed air connection. The provision of a pressurized gas, in particular of compressed air, allows the cleaned and/or disinfected packing machine or the cleaned and/or disinfected components of the packing machine to be dried by being blown on after a cleaning and/or disinfection process.

Preferably, in a packing machine according to the invention, spray nozzles are provided in the region of the components to be cleaned. In this way, the cleaning fluid and/or the disinfecting fluid can be automatically applied to the machine components to be cleaned. For this purpose, the fluid unit is provided with one or more pumps to convey the cleaner fluid and/or the disinfecting fluid at the required pressure to the spray nozzles in the region of the machine components to be cleaned.

In principle, the entire packing machine with all of the modules, in particular the shaping station, the sealing station or the cutting station, can be cleaned in accordance with the invention. In particular, the lifting units or the tools of the shaping, sealing and cutting stations can in this case also automatically be subjected to cleaning in accordance with the invention. For this purpose, the aforementioned spray nozzles are arranged at the required points.

In addition, the invention is particularly advantageous in the cleaning of conveyor chains, in particular of conveyor chains for the conveyance of films of a packing machine. For this purpose, corresponding spray nozzles are advantageously arranged in the region of a conveyor chain of this type for the conveyance of films.

The types of packing machines mentioned at the outset generally have a conveyor chain which is equipped with clamping units for grasping and conveying a film for packs to be sealed. As a chain is obviously equipped with many joints, a chain of this type must for reasons of hygiene be cleaned and disinfected particularly regularly and particularly reliably in order to meet the high hygiene standards in the field of the packing of food products. Machine-side cleaning components which are provided in accordance with the invention allow the conveyor chain to be cleaned particularly easily, as the spray nozzles for wetting the chain with cleaner fluid and/or disinfecting fluid can be arranged in such a way that the chain is wetted completely and for a good contact time.

For cleaning and/or disinfecting the chain during operation, the spray nozzles are for example arranged in the region of the lower strand and/or of deflection of the lower strand. In this region, it is in principle possible to clean the conveyor chain which can then reach the upper strand clean and dry.

In a preferred embodiment of the invention, the cleaning is however carried out at specific cleaning intervals during which the packing machine is not used for packing products to be packed. The number and the duration of cleaning intervals of this type can be defined by operators or else be determined by the nature of the product to be packed or by the degree of soiling, sensors also being present in developments of the invention to display required cleaning.

Especially when cleaning is carried out in cleaning intervals outside the packing operation of the packing machine, the spray nozzles for the cleaning fluid can be arranged throughout the region of the machine, thus allowing the entire machine, including the machine frame and the shaping, sealing and cutting stations with the associated lifting units and tools, to be cleaned. In such a case, for cleaning the chain, the spray nozzles are preferably arranged in the region of the chain guide, thus allowing not only the chain itself, but rather also the guide elements thereof to be subjected to automatic cleaning and/or disinfection.

As packing machines can also have, as stated hereinbefore, in particular in the region of the machine frame, cavities or other regions which can be externally accessible to cleaning staff only with difficulty, it is expedient in the case of a packing machine according to the invention to arrange the spray nozzles in particular in machine regions of this type, for example in hollow profiles or the like, in order to ensure rapid and sufficient wetting with cleaner and/or disinfecting fluid precisely in machine regions of this type.

To produce spray nozzles according to the invention, a perforated tube is advantageously used, at least in part. Such a formation of the spray nozzles offers the advantage of causing both guidance of the line for the cleaning and/or disinfecting fluid and at the same time the nozzle function for spraying the fluid and thus also wetting the machine components to be cleaned.

Advantageously, nozzles having differing jet directions onto the components to be cleaned are provided for spraying the cleaning and/or disinfecting fluid.

Differing jet directions are intended to ensure complete wetting of the machine components to be cleaned, thus improving the result of the cleaning.

Furthermore, in the case of a packing machine according to the invention, a control unit is advantageously provided for controlling at least one cleaning and/or disinfection program. A machine controller of this type can be configured as an independent, stand-alone controller which is provided with an interface to the machine controller of the packing machine or other input and/or display elements. In another variant embodiment, the control unit for controlling the cleaning and/or disinfection processes is integrated into the machine controller of the packing machine. In both cases, a packing machine configured in this way is capable of automatically carrying out, depending on the defined program, cleaning and/or disinfection of the machine or machine components to be cleaned.

A control unit as specified above can in this case also be provided with an external interface to allow an exchange of data. An exchange of data is advantageous, for example, for the loading and/or changing of cleaning and/or disinfection programs. In addition, via an interface of this type, the control unit of a packing machine can be coordinated with other controllers, for example of other packing machines or other machines and installation components in the product line, for example to trigger simultaneous automatic cleaning during downtime of a product line.

A cleaning program of this type can in this case comprise differing spray times, maintenance times and drying times. Furthermore, manual cleaning intervals can be integrated into cleaning programs of this type, for example via pause circuits or the like. Guidance of cleaning staff by sound or visual instructions or displays can in this case also be provided.

The cleaning time intervals and also the precise sequence of individual program portions can in this case be implemented as desired. In one particular embodiment of the invention, differing cleaning programs are in this case provided for differing products to be packed.

Advantageously, a data memory is in addition provided for documenting cleaning processes which have been carried out. A data memory of this type can for example be accommodated in the region of the controller for one or more cleaning programs. It is however also possible to transmit, as stated above, the data required for the purposes of documentation to a separate external documentation unit via an external interface. The documentation of cleaning processes can in this case contain detailed information, for example about the cleaning agents and/or disinfectants used, about time intervals and also details about the success of cleaning processes.

For demonstrating cleaning results, in a further advantageous embodiment, corresponding sensors, for example optical sensors, cameras or the like, can also be attached, the measurement data of which, for example in the form of images, can also be stored for the purposes of documentation.

Such documentation can subsequently be advantageous for different purposes, for example for troubleshooting, in particular also in the event of the contamination of packed products. Such documentation can be used for example to demonstrate that any contamination of the packed product did not seep in via the packing machine.

An exemplary embodiment of the invention is illustrated in the drawings and will be described hereinafter in greater detail with reference to the below figures.

DETAILED DESCRIPTION

Figure 1:
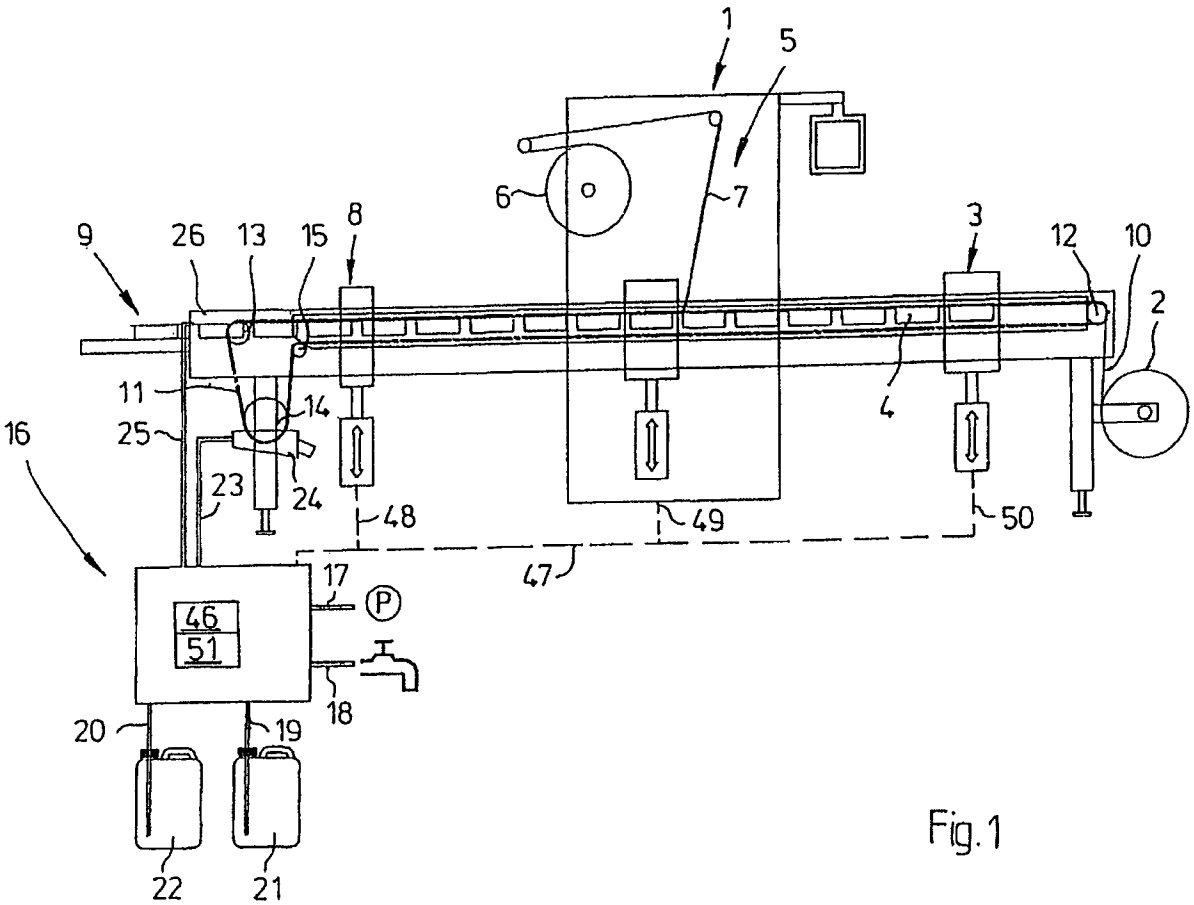
FIG. 1 is a schematic view of a packing machine according to the invention.

The packing machine 1 is what is known as a roller or deep drawing machine which shapes packing troughs 4 in a shaping station 3 from film removed from a supply roller 2. The packing troughs 4 are filled and subsequently sealed in a sealing station 5 with the aid of a cover film 7 removed from a further supply roller 6.

In a cutting station 8, the individual packs are cut out from the overall composite and subsequently transferred to a discharge belt 9 for discharge from the packing machine. The film 10, and thus also the packing trough 4, is conveyed via a conveyor chain 11 which is configured so as to revolve via deflection rollers 12, 13, 14, 15.

A fluid supply unit 16 comprises a compressed air connection 17, a water connection 18 and a connection for supplying disinfectant and a connection 20 for supplying a cleaner. A disinfection storage container 21 and a cleaner container 22 are connected to the fluid unit 16 via connecting lines and also the connections 19, 20.

A metering and/or mixing unit 51 allows the cleaning fluid supplied to the packing device to be prepared in such a way that any desired concentration and/or mixture of one or more cleaning fluids can be prepared and provided via corresponding connecting lines and outlets in the region desired for cleaning. Thus, for example, in a first cleaning process the respective regions of the device can simply be sprayed down with water for basic cleaning, optionally followed by a cleaning mixture for what is known as a soaking process, a subsequent cleaning process by means of a cleaning fluid which is applied for example undiluted, and a final rinsing and/or drying process by supplying water and/or air.

The fluid supply unit 16 further comprises an output line 23 which is connected to a spray unit 24 in the region of the lower deflection roller 14 of the conveyor chain. An output line 25, which is introduced into a hollow longitudinal bar 26 of the packing machine 1, also issues from the fluid supply unit 16.

The output line 25 branches in the longitudinal bar 26 into two spray lines 27, 28 (cf. FIG. 2) in the form of a perforated tube.

The spray line 27 is arranged between the upper strand 29 and the lower strand 30 of the conveyor chain 11 and thus also at the level of the associated chain guides 31, 32, 33, 34. The spray line 27 is provided with upwardly directed spray nozzles 35 and also with downwardly directed spray nozzles 36 from which a cleaning and/or rinsing liquid and/or a disinfectant can be sprayed out. The spray jets are shown fanned out, for example with reference to the spray jet 37.

The longitudinal bar 26 comprises a hollow profile 38 in which the spray line 28 is arranged. The spray line also comprises spray nozzles 39 from which spray jets 40 issue.

Figure 2:
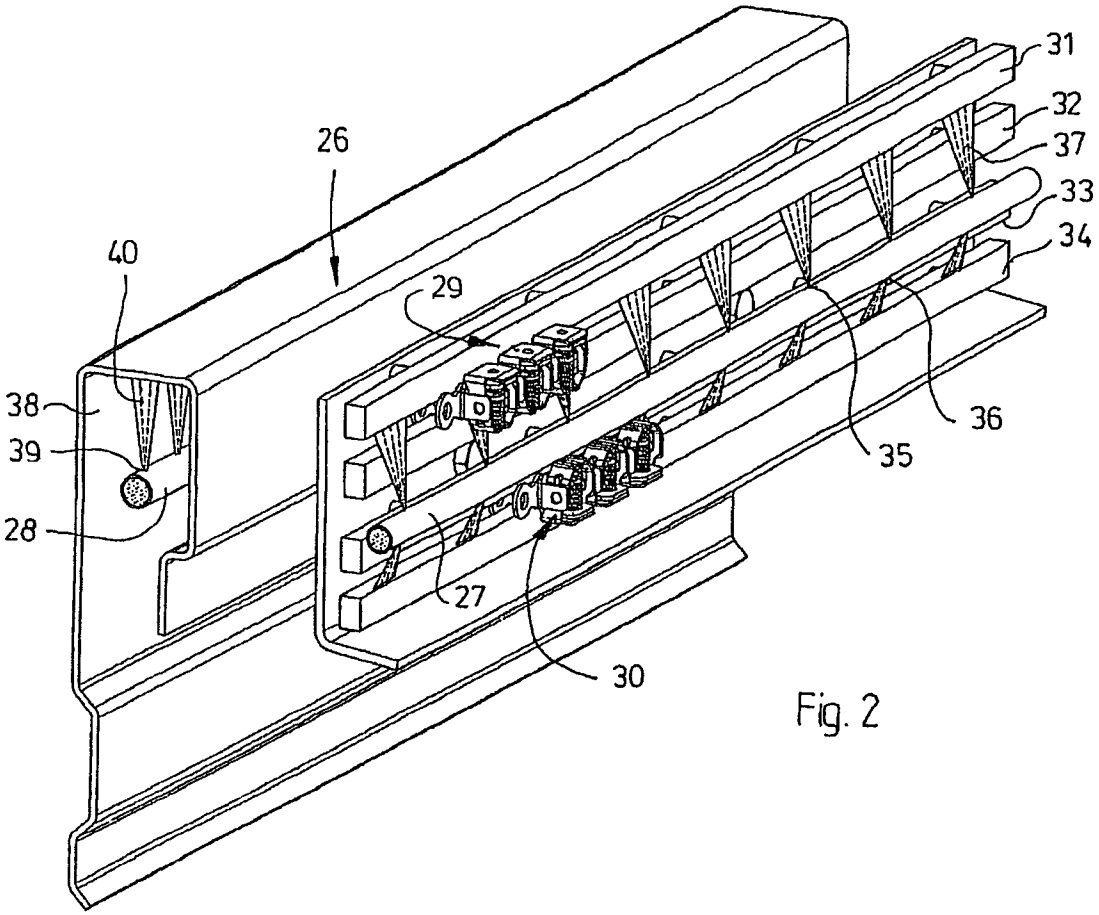
FIG. 2 is a perspective view of a detail from a packing machine according to FIG. 2.

As may be seen from FIG. 2, cleaning of the corresponding machine components can be brought about via the spray line 27, 28 or spray nozzle 35, 36, 39. Via the spray line 27, the conveyor chain 11 can be completely wetted, cleaned and/or rinsed down, together with the chain guide 31, 32, 33, 34, both in the region of the upper strand 29 and in the region of the lower strand 30.

The interior of the hollow profile 38, which is otherwise difficult to access, can also be wetted with a corresponding fluid and thus cleaned, rinsed, disinfected, etc. via the spray line 28.

Figure 3:
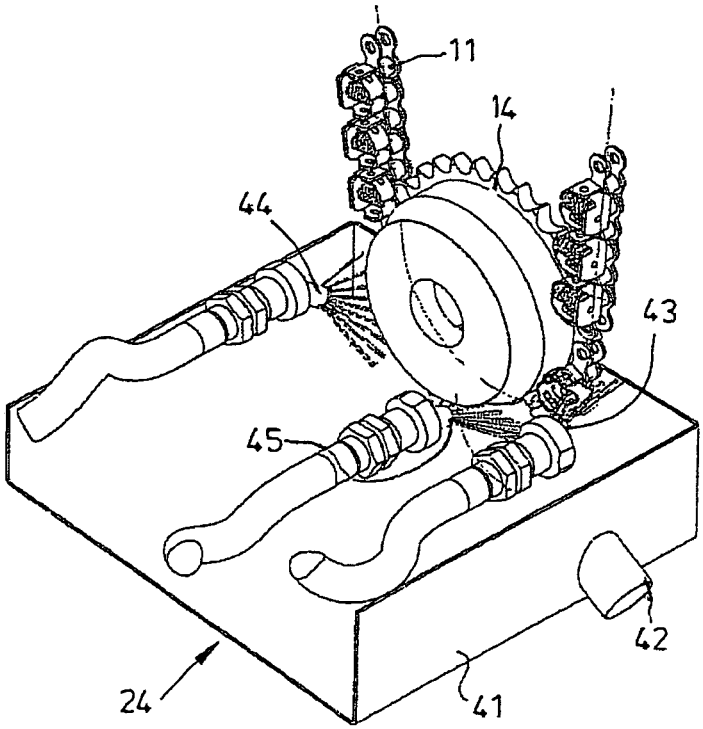
FIG. 3 is a perspective view from the region of deflection of the conveyor chain of a packing machine according to the invention.

FIG. 3 shows the spray unit 24 which comprises a collection tank 41 with an outlet 42 and three spray nozzles 43, 44, 45. The spray nozzles 43, 44, 45 are directed toward the conveyor chain 11 which revolves about the lower deflection roller 14.

Thus, the spray unit 24 allows the conveyor chain 11 to be cleaned in the region of this lower deflection roller 14, and thus far away from the plane of conveyance of the packs formed from the packing troughs 4.

Under certain circumstances, continuous operation of the spray unit 24 is possible at this point, while the packing machine 1 is running. Generally, however, the cleaning is carried out, in particular in the region illustrated in FIG. 2, in pauses in the operation of the packing machine 1, in which no packs are produced, filled, sealed and cut, so that there is no risk of the sprayed cleaning agent entering into contact with the packs.

In FIG. 1, broken lines denote a further output line and branches 48, 49, 50. The branches 48, 49, 50 lead to the shaping station 3, to the sealing station 5 and to the cutting station 8. This illustrates that these machine components and the units accommodated therein, such as lifting units, tools or the like and, in a manner not shown in greater detail, the machine frame or the packing machine 1 as a whole can, in accordance with the invention, access automatic cleaning by way of the fluid supply unit 16.

The fluid supply unit 16 according to the invention is capable of selecting a cleaning fluid as desired, or of mixing a cleaning fluid and supplying it to the corresponding spray nozzles 35, 36, 39 via the output lines 23, 25.

In this case, the fluid supply unit 16 is capable of selectively performing differing cleaning, disinfecting and rinsing program steps via a schematically illustrated control unit 46 which does not necessarily have to be spatially connected to the fluid supply unit 16, but rather can also be accommodated in the machine controller or at another location.

The fluid supply unit 16 is equipped for this purpose, for example, with one or more fluid pumps, a mixing unit and/or a metering unit with corresponding control valves.

A cleaning fluid can either be obtained ready-to-use from the cleaner container 22 serving as a cleaner store or can be obtained as a concentrate from this storage container 22 and mixed with water from the water line 17 to form a ready-to-use cleaning liquid. The disinfectant, which is obtained from the storage container 21 serving as a disinfection store, can also be obtained ready-to-use from the container 21 or be used as an additive for the cleaning liquid or for a disinfecting liquid which is mixed from disinfectant and water.

Via the water connection 18, it is not only possible to prepare cleaner liquid or optionally also disinfecting liquid; on the contrary, it is also possible to carry out a pure rinsing operation in order to rinse off previously sprayed cleaner agent or disinfectant from the machine components to be cleaned.

Subsequent blow-drying is possible via the compressed air connection 17. The compressed air connection 17 can however also be used to blow off, prior to cleaning with a cleaning fluid, any solids from the machine components to be cleaned. The compressed air can in this case be passed via the same lines and nozzles as the aforementioned liquids.

Figure 4:
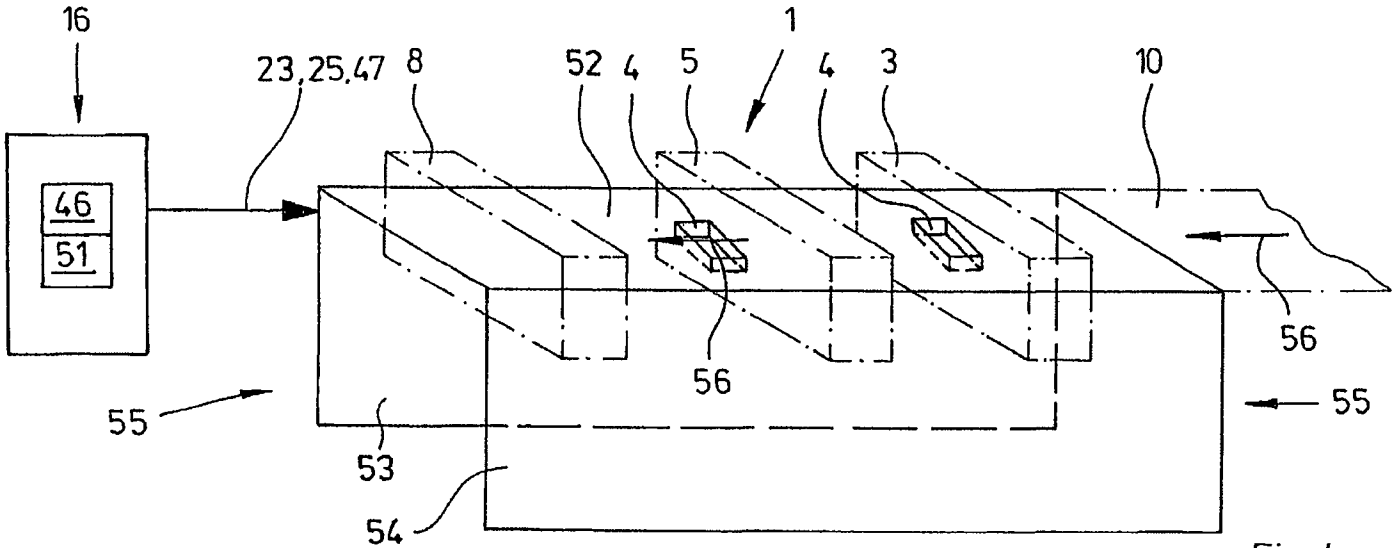
FIG. 4 is a schematic perspective view of an interior of a packing machine.

FIG. 4 is a schematic perspective view of the region 55 of the packing machine 1 that is to be cleaned by the fluid supply unit and is formed below a plane of conveyance 52 for tray-like packing containers, illustrated in this case by way of example by the packing troughs 4, and lateral delimitations of the packing machine 1, illustrated in this case by the two side walls 53 and 54. This region 55 is thus the basic interior of the packing machine 1 which, depending on the embodiment, can be fitted with differing working stations 3, 5, 8. In the case of a deep drawing packing machine, for example, all three working stations—the shaping station 3, sealing station 5 and cutting station 8—can be provided. In the case of a tray sealer embodiment, on the other hand, only one sealing station 5 and optionally a subsequent cutting station 8 for separating and/or cutting continuous packs to size might for example be provided.

In a further embodiment, it would however also be possible for the packing machine to have all of the working stations 3, 5, 8 illustrated by way of example in FIG. 4 and for a supply means for tray sealers additionally to be provided, so that both preproduced, tray-like packs can be processed using a packing machine of this type and, for the respective application, it is possible to carry out shaping from a film 10, shown in this case again by way of example, sealing after filling with the product to be packed, and subsequently cutting-to-size in the cutting station 8. The tray-like packing containers 4 or the film 10 are conveyed through the packing machine 1 along the direction of conveyance as indicated by arrow 56.

With regard to the fluid supply unit 16, FIG. 4 shows for the sake of clarity merely symbolically and in a representative manner certain elements, such as for example the control unit 46, the metering and/or mixing unit 51 and, in a manner representative of the various supply lines and connections, the connections 23, 25 and 47 as a single connection between the fluid supply unit 16 and the region 55 to be supplied with cleaning agent through said connections below the plane of conveyance 52 and the side walls 53 and 54 of the packing machine 1.

LIST OF REFERENCE NUMERALS

1 Packing machine
2 Supply roller
3 Shaping station
4 Packing trough
5 Sealing station
6 Supply roller
7 Cover film
8 Cutting station
9 Discharge belt
10 Film
11 Conveyor chain
12 Deflection roller
13 Deflection roller
14 Deflection roller
15 Deflection roller
16 Fluid supply unit
17 Compressed air connection
18 Water connection
19 Connection
20 Connection
21 Disinfection storage container
22 Cleaning container
23 Output line
24 Spray unit
25 Output line
26 Longitudinal bar
27 Spray line
28 Spray line
29 Upper strand
30 Lower strand
31 Chain guide
32 Chain guide
33 Chain guide
34 Chain guide
35 Spray nozzle
36 Spray nozzle
37 Spray jet
38 Hollow profile
39 Spray nozzle
40 Spray jet
41 Collection tank
42 Outlet
43 Spray nozzle
44 Spray nozzle
45 Spray nozzle
46 Control unit
47 Output line
48 Branch
49 Branch
50 Branch
51 Metering and/or mixing unit
52 Plane of conveyance
53 Side wall
54 Side wall
55 Interior
56 Arrow

The invention claimed is:

1. A packing machine for packing products in packing containers and having components which have to be cleaned regularly, the packing machine comprising:

side walls;

a region that is arranged between the side walls and below a plane of conveyance for the packing containers;

a conveyor chain for conveying the packing containers along the plane of conveyance, the conveyor chain having an upper strand and a lower strand;

a hollow longitudinal bar positioned adjacent the conveyor chain;

a fluid supply unit that is provided for cleaning the region of the packing machine that is configured below the plane of conveyance for the packing containers; and a closed and/or open-loop control unit for carrying out multiple different cleaning programs using the fluid supply unit; and multiple spray lines in fluid communication with the fluid supply unit and configured to receive fluid from the fluid supply unit, the spray lines including a first spray line arranged between the upper strand and the lower strand of the conveyor chain for spraying fluid on the conveyor chain, and a second spray line arranged in the longitudinal bar for spraying fluid inside the longitudinal bar, each spray line including multiple spray nozzles for spraying the fluid.

2. The packing machine as claimed in claim 1, wherein the fluid supply unit is configured to provide at least one cleaning fluid.

3. The packing machine as claimed in claim 1 or claim 2, wherein the fluid supply unit comprises a metering and/or mixing unit.

4. The packing machine as claimed in claim 1, wherein the fluid supply unit comprises a water connection for taking up water.

5. The packing machine as claimed in claim 1, wherein the fluid supply unit has at least one connection for at least one supply of cleaner.

6. The packing machine as claimed in claim 1, wherein the fluid supply unit has at least one connection for the supply of at least one disinfectant.

7. The packing machine as claimed in claim 1, wherein the fluid supply unit has at least one store for at least one cleaner.

8. The packing machine as claimed in claim 1, wherein the fluid supply unit comprises at least one store for at least one disinfectant.

9. The packing machine as claimed in claim 1, wherein the fluid supply unit comprises at least one compressed gas connection.

10. The packing machine as claimed in claim 1 wherein the spray nozzles are provided in the region of the packing machine to be cleaned for applying the fluid, which includes a cleaner and/or disinfectant.

11. The packing machine as claimed in claim 1 wherein the spray nozzles of the first spray line are provided in a region of the conveyor chain for applying a cleaner and/or a disinfectant.

12. The packing machine as claimed in claim 1, further comprising an additional spray nozzle in fluid communication with the fluid supply unit and provided in a region of deflection between the upper strand and the lower strand of the conveyor chain for applying at least one cleaner and/or at least one disinfectant.

13. The packing machine as claimed in claim 1, further comprising a chain guide associated with the conveyor chain, wherein the spray nozzles of the first spray line include a spray nozzle provided in a region of the chain guide for applying at least one cleaner and/or at least one disinfectant.

14. The packing machine as claimed in claim 1 wherein at least one of the spray nozzles is arranged in at least one cavity of the packing machine for applying at least one cleaner and/or at least one disinfectant.

15. The packing machine as claimed in claim 1 wherein the first spray line and the second spray line each comprise a perforated tube that defines the associated spray nozzles.

16. The packing machine as claimed in claim 1 wherein the spray nozzles have various jet directions for wetting at least one machine region to be cleaned or at least one machine component to be cleaned.

17. The packing machine as claimed in claim 1, further comprising a data memory for documenting cleaning processes which have been carried out.

18. A packing machine for packing products in packing containers that are conveyed along a plane of conveyance, the packaging machine comprising:

side walls;

a region that is arranged between the side walls and below the plane of conveyance;

a conveyor chain for conveying the packing containers along the plane of conveyance, the conveyor chain having an upper strand and a lower strand;

a hollow longitudinal bar positioned adjacent the conveyor chain;

a fluid supply unit including a metering unit;

a storage container connected to the fluid supply unit for storing a cleaner;

multiple spray lines in fluid communication with the fluid supply unit and configured to receive the cleaner from the fluid supply unit, the spray lines including a first spray line arranged between the upper strand and the lower strand of the conveyor chain for spraying cleaner on the conveyor chain, and a second spray line arranged in the longitudinal bar for spraying cleaner inside the longitudinal bar, each spray line including multiple spray nozzles arranged in the region for applying the cleaner to the region; and a control unit for carrying out multiple different cleaning programs using the fluid supply unit, wherein the multiple cleaning programs are provided for differing products to be packed by the packing machine, and wherein the metering unit is configured to provide the cleaner in various concentrations to the spray nozzles.

19. The packing machine as claimed in claim 1 wherein the multiple cleaning programs are stored on the control unit and are provided for differing products to be packed by the packing machine.

20. The packing machine as claimed in claim 1 wherein the control unit includes an external interface to allow for loading and/or changing of cleaning programs.

21. The packing machine as claimed in claim 1 wherein the control unit is configured to communicate with a controller of another packing machine of a particular product line to coordinate cleaning operations.

* * * * *